US010305237B1

(12) United States Patent
Li

(10) Patent No.: US 10,305,237 B1
(45) Date of Patent: May 28, 2019

(54) ADAPTER

(71) Applicant: Fayeung Lighting CO., LTD, Dongguan (CN)

(72) Inventor: Zhaoyuan Li, Dongguan (CN)

(73) Assignee: FAYEUNG LIGHTING CO., LTD, Dongguan (CN)

( * ) Notice: Subject to any disclaimer, the term of this patent is extended or adjusted under 35 U.S.C. 154(b) by 0 days.

(21) Appl. No.: 16/025,733

(22) Filed: Jul. 2, 2018

(30) Foreign Application Priority Data

May 23, 2018 (CN) ..... 2018 2 0776834 U

(51) Int. Cl.

| | |
|---|---|
| ***H01R 31/06*** | (2006.01) |
| ***H01R 31/02*** | (2006.01) |
| ***H01R 13/42*** | (2006.01) |
| ***H01R 13/33*** | (2006.01) |
| ***H01R 13/405*** | (2006.01) |

(52) U.S. Cl.
CPC ..... *H01R 31/06* (2013.01); *H01R 13/33* (2013.01); *H01R 13/405* (2013.01); *H01R 13/42* (2013.01); *H01R 31/02* (2013.01)

(58) Field of Classification Search
CPC .... H01R 31/036; H01R 13/33; H01R 13/405; H01R 13/42
USPC ..... 439/692
See application file for complete search history.

(56) References Cited

U.S. PATENT DOCUMENTS

| | | | | |
|---|---|---|---|---|
| 4,275,374 | A * | 6/1981 | Chaucer | H01R 13/68 337/197 |
| 5,281,158 | A * | 1/1994 | Lin | F21S 4/10 200/51.1 |
| 8,936,379 | B1 * | 1/2015 | Chen | F21V 21/002 362/249.19 |
| 9,044,056 | B2 * | 6/2015 | Chen | A41G 1/005 |
| 9,222,656 | B2 * | 12/2015 | Chen | A47G 33/06 |
| 9,439,528 | B2 * | 9/2016 | Chen | A47G 33/06 |
| 9,671,074 | B2 * | 6/2017 | Chen | A47G 33/06 |
| 9,883,566 | B1 * | 1/2018 | Chen | H05B 37/0272 |
| 9,883,706 | B2 * | 2/2018 | Chen | A47G 33/06 |
| 9,894,949 | B1 * | 2/2018 | Chen | F21S 4/001 |

* cited by examiner

*Primary Examiner* — Alexander Gilman
(74) *Attorney, Agent, or Firm* — Hemisphere Law, PLLC; Zhigang Ma

(57) ABSTRACT

The present application relates to an adapter. The adapter includes a base and an adapter head inserted and fixed on the base. The base includes two base copper terminals mounted thereon and two connector wire holes defined therein, the connector wire hole is configured for inserting a connecting wire to contact with the base copper terminal, an assembling portion protruding out from a bottom end of the base is defined. The adapter head includes two adapter head copper terminals mounted thereon and two plug wire holes defined therein. The two adapter head copper terminals are in contact with the two base copper terminals, respectively. The plug wire hole is configured for inserting a plug wire to contact with the base copper terminal. An assembling hole is formed in a top end of the adapter head.

16 Claims, 6 Drawing Sheets

ADAPTER

FIELD OF THE DISCLOSURE

The disclosure relates to the field of adapter technologies, and more particularly to an adapter that facilitates multi-section connections.

BACKGROUND

In the installation of the Christmas tree, the Christmas tree includes trunk, branches, and a lot of decorative lighting hanging on the branches. Because some Christmas tree is large and relatively high, the decorative lighting on the Christmas tree is divided into multiple sections from the bottom to the top. During the installation, an ordinary adapter is used to energize the lighting on the Christmas tree. However, due to the dense arrangement of components on the Christmas tree, it is difficult to install the adapter in the actual circuit connection, so a large amount of time is wasted in assembly and improvement is needed.

SUMMARY

On such basis, it is necessary to provide an adapter which is convenient to be installed on the sectional trunk of the Christmas tree so as to facilitate the circuit connection of the decorative lighting hanging on the Christmas tree.

In one embodiment, the present disclosure provides an adapter. The adapter includes a base and an adapter head inserted and fixed on the base. The base includes two base copper terminals mounted thereon and two connector wire holes defined therein, wherein the connector wire hole is configured for inserting a connecting wire to contact with the base copper terminal, wherein an assembling portion protruding out from a bottom end of the base is defined. The adapter head includes two adapter head copper terminals mounted thereon and two plug wire holes defined therein, wherein the two adapter head copper terminals are in contact with the two base copper terminals respectively, wherein the plug wire hole is configured for inserting a plug wire to contact with the base copper terminal, wherein an assembling hole is formed in a top end of the adapter head.

In one embodiment, the base defines a first mounting slot extending downwards from the top of the base, a second mounting slot extending upwards from the bottom of the base, and a first hollow out opening extending downwards from the top of the base, the second mounting slot corresponds to the first mounting slot and is located on the outside of the first mounting slot, the first hollow out opening corresponds to and is communicated with the second mounting slot, the first hollow out opening is located on the outside of the second mounting slot, the two base copper terminals are inserted into the first and second mounting slots respectively, a first fixing block mounted on the base is provided at the bottom end of the second mounting slot.

In one embodiment, the assembling hole is a counter bore structure, a third mounting slot is defined extending downwards from the top of the assembling hole, a second hollow out opening is provided beside of the third mounting slot, the base copper terminal of the first mounting slot is exposed in the second hollow out opening, a protrusion is provided at the outer wall of the adapter head and extends downward below the first hollow out opening, a fourth mounting slot is defined in the protrusion extending from the top to the bottom thereof, a second fixing block is defined at the top end of the fourth mounting slot and is mounted on the protrusion, the two adapter head copper terminals are installed in the third mounting slot and the fourth mounting slot, respectively.

In one embodiment, an upper end of the adapter head copper terminal installed in the third mounting slot is bent and snapped onto a step surface of the assembling hole, the plug wire passes through the plug wire hole and is in contact with the bent upper end of the adapter head copper terminal.

In one embodiment, an annular baffle is disposed in the assembling hole and is detachably connected with the adapter head.

In one embodiment, the outer wall of the base defines a connector wire fixing part, and the outer wall of the adapter head defines a plug wire fixing part.

In one embodiment, a bulgy rib is defined at the adapter head, and a recess that exactly engages with the bulgy rib is defined in the base.

In one embodiment, the two base copper terminals are parallel with each other, the two adapter head copper terminals are parallel with each other, the base copper terminals are parallel with the adapter head copper terminals.

In one embodiment, the base defines a first mounting slot and a second mounting slot, the two base copper terminals are installed in the first and second mounting slots respectively, the adapter head defines a third mounting slot and a fourth mounting slot, the two adapter head copper terminals are installed in the third and the fourth mounting slots respectively, the first, the second, the third, and the fourth mounting slots are parallel.

In one embodiment, the adapter head Includes a fitting portion at the bottom end thereof, the base defines a fitting hole coaxial with the base, and the fitting portion is exactly engaged in the fitting hole of the base.

In one embodiment, the present disclosure provides an adapter. The adapter includes a base and an adapter head. The base includes a fitting hole extending downwards from the top of the base, a first mounting slot defined adjacent to an inner wall of the base, at least portion of the first mounting slot being exposed in the fitting hole, a second mounting slot adjacent to an outer wall of the base and at least portion of the second mounting slot being exposed in the exterior, two base copper terminals installed in the first and second mounting slots respectively, two connector wire holes each configured for inserting a connecting wire to contact with the base copper terminal, and an assembling portion positioned at the bottom of the base. The adapter head includes a main body, a fitting portion extending from the bottom of the main body, a protrusion defined on an outer wall of the main body and comprising a extending portion spaced and opposite to the fitting portion, a third mounting slot extending from the main body to the fitting portion and at least portion of the third mounting slot being exposed in the exterior, a fourth mounting slot extending from the protrusion to the extending portion and at least portion of the fourth mounting slot being exposed in the exterior, two adapter head copper terminals installed in the third and fourth mounting slots respectively, two plug wire holes each configured for inserting a plug wire to contact with the base copper terminal, and an assembling hole formed in a top end of the main body. The fitting portion is exactly engaged in the fitting hole of the base, thereby the adapter head copper terminal in the third mounting slot is in contact with the base copper terminal in the first mounting slot, and the adapter head copper terminal in the fourth mounting slot is in contact with the base copper terminal in the second mounting slot.

In one embodiment, an annular baffle is disposed in the assembling hole and is detachably connected with the adapter head.

In one embodiment, the outer wall of the base defines a connector wire fixing part, and the outer wall of the adapter head defines a plug wire fixing part.

In one embodiment, a bulgy rib is defined at the adapter head, and a recess that engages with the bulgy rib is defined in the base.

In one embodiment, the two base copper terminals are parallel with each other, the two adapter head copper terminals are parallel with each other, and the base copper terminals are parallel with the adapter head copper terminals.

In one embodiment, the base copper terminals and the adapter head copper terminals each parallel with an axial of the fitting hole.

In one embodiment, the fitting hole is coaxial with the fitting portion.

According to the adapter in the embodiment of the disclosure, the base can be mounted on the lower section of the tree trunk of the Christmas tree via the assembling section, and the adapter head can be inserted into the base, and the assembling hole at the upper end of the adapter head is connected with the upper section of the tree trunk of the Christmas tree, so that the adapter can be fixed between two sections of tree trunks. According to the actual situation, multiple adapters can be used to connect with multi-sections of tree trunks. Then during the latter circuit connection period, the corresponding adapter can be found directly on the section of the tree trunk, and the circuit can be connected to light up the lighting on the Christmas tree, by connecting the connector wires and the plug wires with the corresponding components. In detail, the base defines base copper terminals, the adapter head defines adapter head copper terminals, which are in contact with the base copper terminals. After connecting the internal circuit of the adapter, and then the electrical signals are transmitted through the connector wires and the plug wires respectively to achieve the connection between the adapter and the external circuit, thereby connecting the external circuit and the internal circuit of the adapter installed on the tree trunk of the Christmas tree.

DETAILED DESCRIPTION OF PREFERRED EMBODIMENTS

Figure 1:
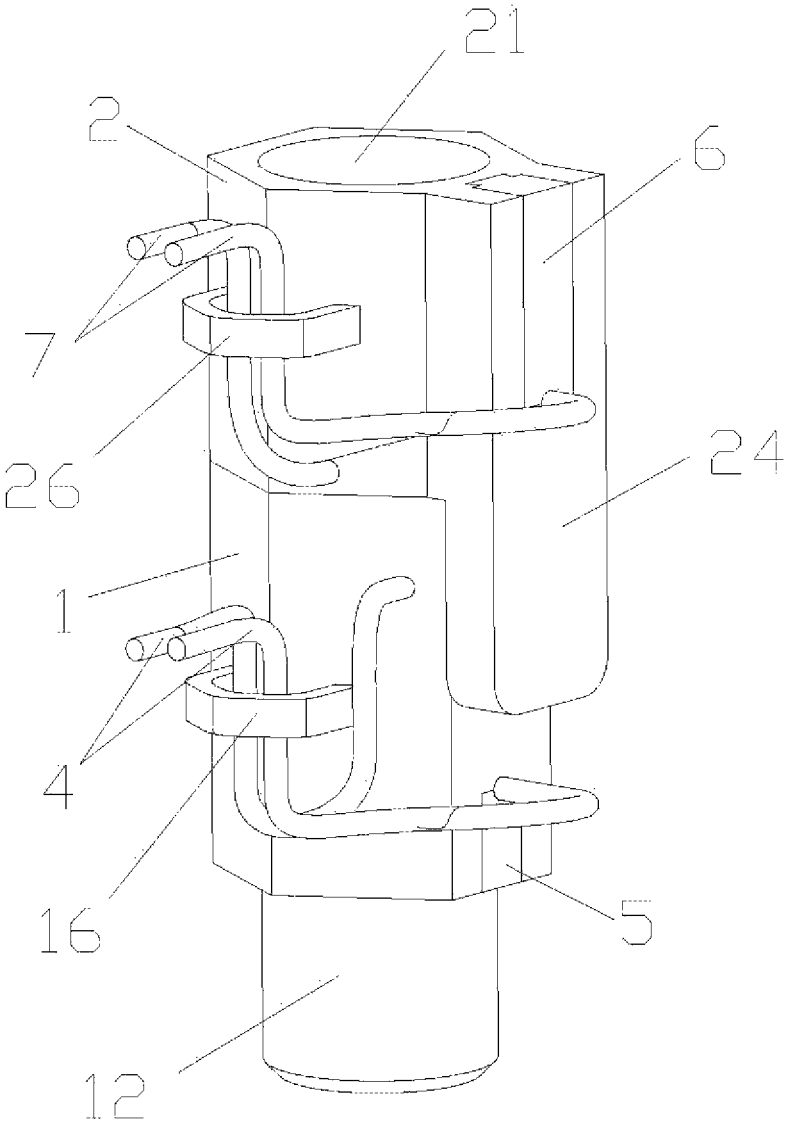
FIG. 1 is an assembled perspective view of an adapter provided by an embodiment of the disclosure.

The specific structural and functional details disclosed herein are only representative and are intended for describing exemplary embodiments of the disclosure. However, the disclosure can be embodied in many forms of substitution, and should not be interpreted as merely limited to the embodiments described herein.

In the description of the disclosure, terms such as "center", "transverse", "above", "below", "left", "right", "vertical", "horizontal", "top", "bottom", "inside", "outside", etc. for indicating orientations or positional relationships refer to orientations or positional relationships as shown in the drawings; the terms are for the purpose of illustrating the disclosure and simplifying the description rather than indicating or implying the device or element must have a certain orientation and be structured or operated by the certain orientation, and therefore cannot be regarded as limitation with respect to the disclosure. Moreover, terms such as "first" and "second" are merely for the purpose of illustration and cannot be understood as indicating or implying the relative importance or implicitly indicating the number of the technical feature. Therefore, features defined by "first" and "second" can explicitly or implicitly include one or more the features. In the description of the disclosure, unless otherwise indicated, the meaning of "plural" is two or more than two. In addition, the term "comprise" and any variations thereof are meant to cover a non-exclusive inclusion.

In the description of the disclosure, is should be noted that, unless otherwise dearly stated and limited, terms "mounted", "connected with" and "connected to" should be understood broadly, for instance, can be a fixed connection, a detachable connection or an integral connection; can be a mechanical connection, can also be an electrical connection; can be a direct connection, can also be an Indirect connection by an intermediary, can be an internal communication of two elements. A person skilled in the art can understand concrete meanings of the terms in the disclosure as per specific circumstances.

The terms used herein are only for illustrating concrete embodiments rather than limiting the exemplary embodiments. Unless otherwise indicated in the content, singular forms "a" and "an" also include plural. Moreover, the terms "comprise" and/or "include" define the existence of described features, integers, steps, operations, units and/or components, but do not exclude the existence or addition of one or more other features, integers, steps, operations, units, components and/or combinations thereof.

The disclosure will be further described in detail with reference to accompanying drawings and preferred embodiments as follows.

Figure 2:
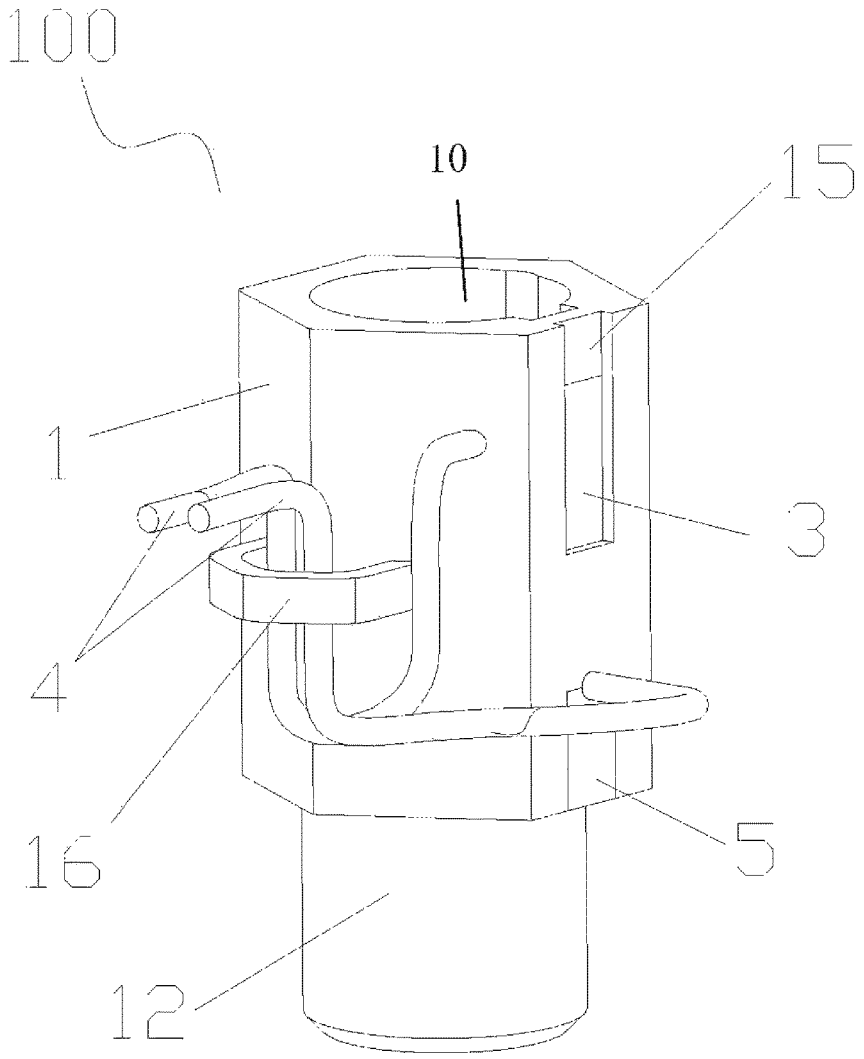
FIG. 2 is an assembled perspective view of a base assembly of the adapter provided by an embodiment of the disclosure.
Figure 3:
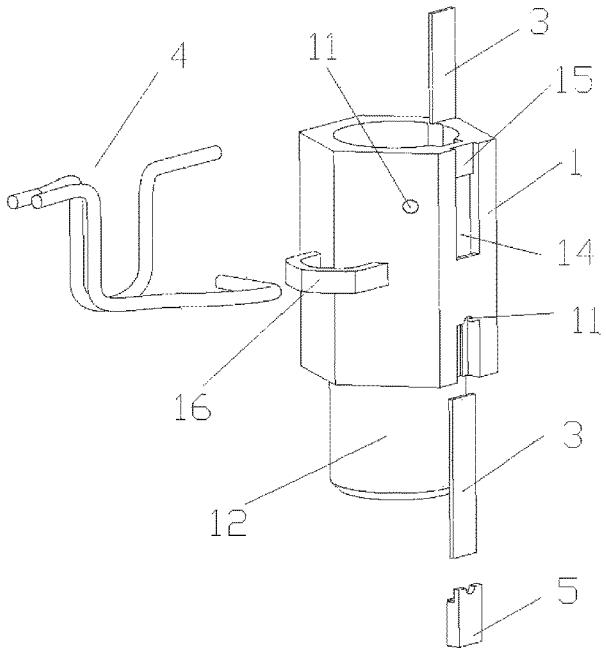
FIG. 3 is an exploded view of the base assembly of the adapter provided by an embodiment of the disclosure.
Figure 4:
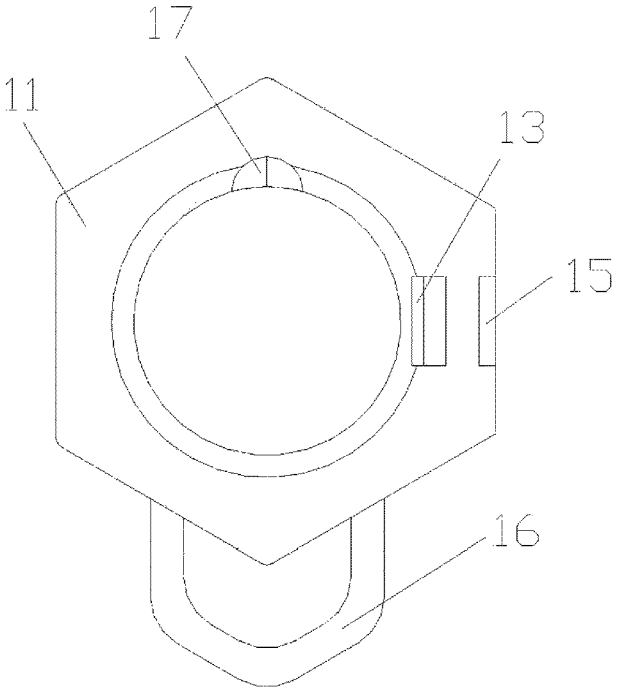
FIG. 4 is a top view of a base of the adapter provided by an embodiment of the disclosure.
Figure 5:
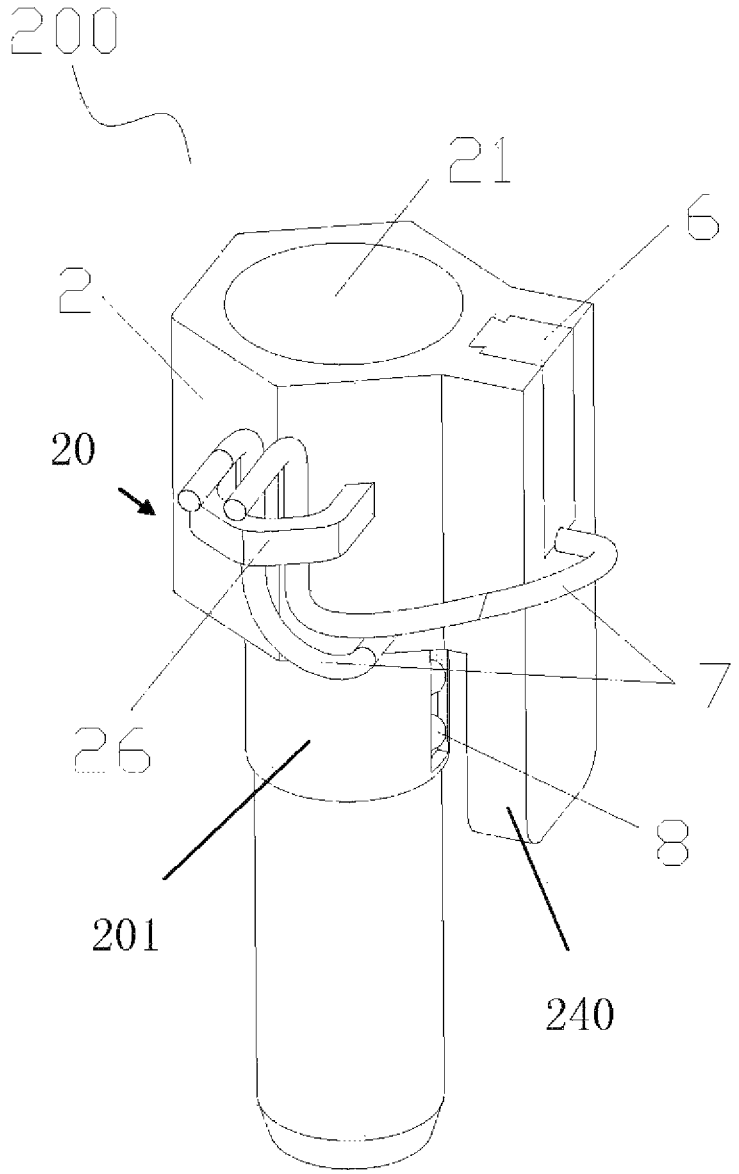
FIG. 5 is an assembled perspective view of an adapter head assembly of the adapter provided by an embodiment of the disclosure.
Figure 6:
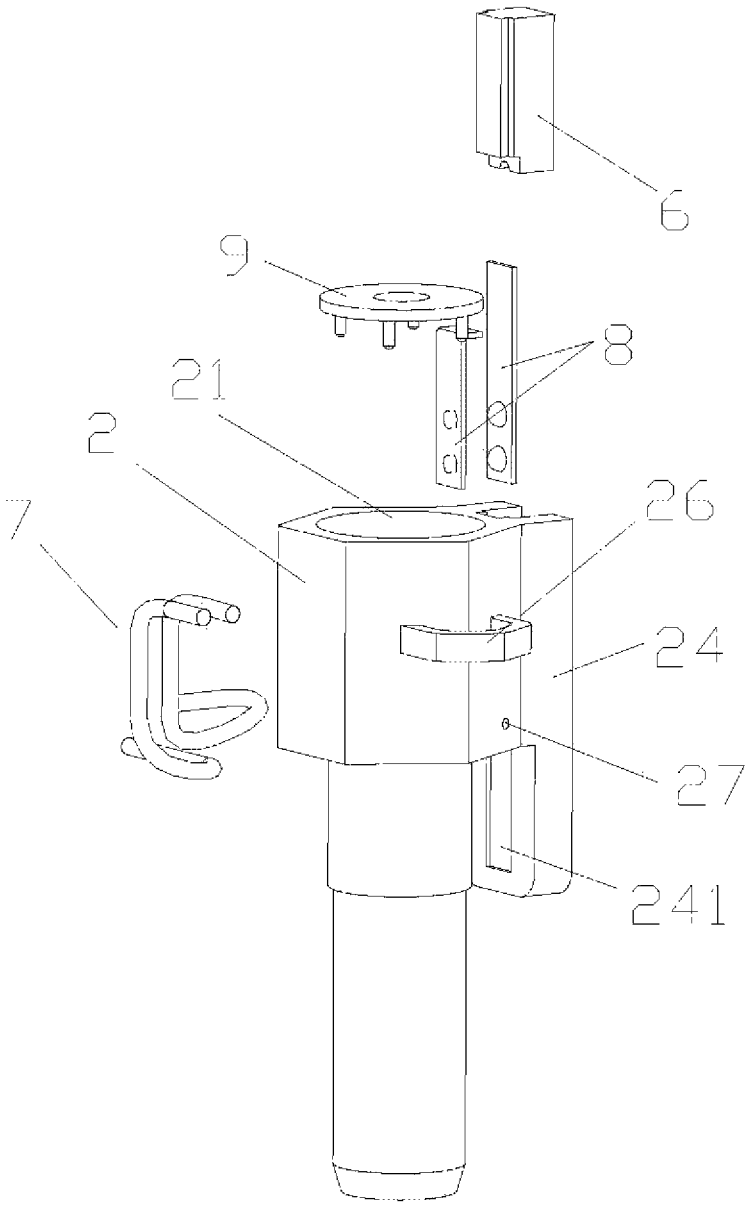
FIG. 6 is an exploded view of the adapter head assembly of the adapter provided by an embodiment of the disclosure.
Figure 7:
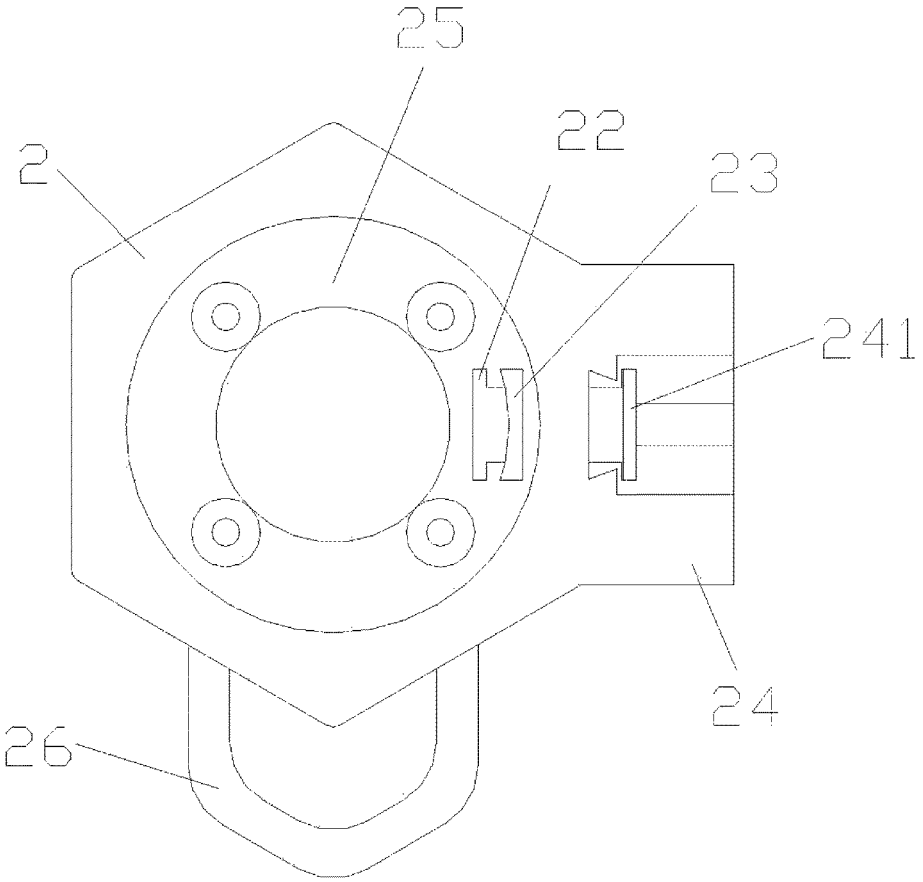
FIG. 7 is a top view of an adapter head of the adapter provided by an embodiment of the disclosure.

Referring to FIG. 1 to FIG. 7, an adapter includes a base 1 and an adapter head 2, and the adapter head 2 is inserted and fixed on the base 1. There are two base copper terminals 3 mounted on the base 1 and two connector wire holes 11 defined in the base 1. The connector wire holes 11 are configured for inserting connector wires 4, and in such a manner the inserted connector wires 4 are in contact with the base copper terminals 3 respectively. The base 1 defines an assembling portion 12 at a bottom end thereof. There are two connector head copper terminals 8 mounted on the adapter head 2 and two plug wire holes 27 defined in the adapter head 2. The connector head copper terminals 8 are in contact with the base copper terminals 3, respectively. The plug wire holes 27 is configured for inserting plug wires 7, and in such a manner the inserted plug wires 7 are in contact with the adapter head copper terminals 8 respectively. An assembling hole 21 is defined in a top end of the adapter head 2. The base 1 can be mounted on a lower section of tree trunk of the Christmas tree via the mounting section 12, the adapter head 2 is inserted into the base 1, and an upper section of tree trunk of the Christmas tree is fitting assembled with the assembling hole 21 in the top end of the adapter head 2. As such, the adapter can be fixed on the sectional tree trunk. According to the actual situation, a lot of adapters can be used to connect with a lot of sections of tree trunks of Christmas tree. Then during the latter circuit connection period, the corresponding adapter can be found directly on the tree trunks and the circuit can be connected to light up the lighting on the Christmas tree.

The base 1 defines a fitting hole 10, into which the adapter head 2 is inserted and thereby attached onto the base 1. The fitting hole 10 is coaxial with the base 1. A first mounting slot 13 is defined at the inner wall of the base 1 and extends downwards from the top of the base 1. A second mounting slot 14 extending upwards from the bottom of the base 1 is provided, and is corresponding to and located outside of the first mounting slot 13. A first hollow out opening 15 extending downwards from the top of base 1 is provided on the outside of the second mounting slot 14. In detail, the first hollow out opening 15 is defined at the outer wall of the base 1, in other words, the second mounting slot 14 is exposed exterior via the first hollow out opening 15. The two base copper terminals 3 are inserted into the first mounting slot 13 and the second mounting slot 14, respectively. A first fixing block 5 mounted on the base 1 is provided at the bottom end of the second mounting slot 14. After the base copper terminals 3 are mounted in the first mounting slot 13 and the second mounting slot 14, the upper end of the base copper terminal 3 in the first mounting slot 13 is exposed in the fitting hole, and the upper end of the base copper terminal 3 in the second mounting slot 14 is exposed in the exterior via the first hollow out opening 15. This facilitates the contact between the base copper terminals 3 and the adapter head copper terminals 8 of the adapter head 2. The first fixing block 5 is installed below the second mounting slot 14 to fix the base copper terminal 3 therein, thereby preventing the base copper terminal 3 falling out therefrom.

The adapter head 2 includes a fitting portion 201 at the bottom end thereof, and the fitting portion 201 is exactly installed in the fitting hole 10 of the base 1. The assembling hole 21 is a counter bored hole extending downward from the top end of the adapter head 2. A person skilled in the art understands that the counter bored hole means a step hole. A third mounting slot 22 is defined in the adapter head 2 and extends downwards from the top thereof. A second hollow out opening 23 is defined beside and communicated with the third mounting slot 22. The base copper terminal 3 in the first mounting slot 13 will be exposed in the second hollow out opening 23. A protrusion 24 is provided at the outer wall of the adapter head 2, and extends downward below the first hollow out opening 15. The protrusion 24 includes an extending portion 240 spaced opposite to the fitting portion 201. A fourth mounting slot 241 is defined in the protrusion 24, and extends from top to bottom thereof. A second fixing block 6 is mounted on the protrusion 24 and is defined at the top end of the fourth mounting slot 241. The fourth mounting slot 241 is parallel to the third mounting slot 22, and is spaced opposite to the second hollow out opening 23. The two adapter head copper terminals 8 are installed in the third mounting slot 22 and the fourth mounting slot 241, respectively. The stepped assembling hole 21 includes a step surface 25, and the third mounting slot 22 extends downwards from the step surface 25. The protrusion 24 is positioned outside of the adapter head 2, and the fourth mounting slot 241 is positioned in the protrusion 24. The third mounting slot 22 and the fourth mounting slot 241 are corresponding to and located adjacent to the first mounting slot 13 and the second mounting slot 14, respectively. The adapter head copper terminals 8 each have contacts on a bottom end thereof. After the adapter head copper terminals 8 are mounted in the third mounting slot 22 and the fourth mounting slot 241, contacts of the adapter head copper terminals 8 are in electrically communication with the base copper terminals 3, respectively. In detail, the adapter head copper terminal 8 in the third mounting slot 22 is positioned inside and electrically communicated with the base copper terminal 3 in the first mounting slot 13, the adapter head copper terminal 8 in the fourth mounting slot 241 is outside the base copper terminal 3 in the second mounting slot 14 and is electrically connected thereto. The second fixing block 6 is configured for fixing the adapter head copper terminal 8 above the fourth mounting slot 241.

In another way, the adapter head 2 includes a main body 20, the fitting portion 201 extending from the bottom end of the main body 20, the protrusion 24 defined on an outer wall of the main body 20 and comprising the extending portion 240 spaced and opposite to the fitting portion 201, the third mounting slot 22 extending from the main body 20 to the fitting portion 201 and exposed in the exterior, the fourth mounting slot 241 extending from the protrusion 24 to the extending portion 240 and exposed in the exterior, two adapter head copper terminals 8 installed in the third mounting slot 22 and the fourth mounting slots 241 respectively, two plug wire holes 27 each configured for inserting the plug wire 7 to contact with the base copper terminal 8, and the assembling hole 21 formed in a top end of the main body 20. Two adapter head copper terminals 8 are spaced opposite to and parallel with each other. The fitting portion 201 is exactly engaged in the fitting hole 10 of the base 1, the adapter head copper terminal 8 in the third mounting slot 22 is in contact with the base copper terminal 3 in the first mounting slot 13, and the adapter head copper terminal 8 in the fourth mounting slot 241 is in contact with the base copper terminal 3 in the second mounting slot 14. The base copper terminals 3 are located between the two adapter head copper terminals 8. The base copper terminals 3 and the adapter head copper terminals 8 are parallel, with an axial of the fitting hole 10, and the fitting hole 10 is coaxial with the fitting portion 201.

The upper end of the adapter head copper terminal 8 mounted in the third mounting slot 22 is bent and snapped onto the step surface 25 of the assembling hole 21. The plug wire 7 passes through the plug wire hole 27 and is in contact with the bent upper end of the adapter head copper terminal 8. In this way, it is convenient for the plug wire 7 to be in contact with the adapter head copper terminal 8, and the disassembly of the adapter head copper terminal 8 is facilitated, it can be taken out directly through the bent portion thereof.

An annular baffle 9 is disposed in the assembling hole 21 and is detachably connected with the adapter head 2. The design of the annular baffle 9 can protect the exposed portion of the adapter head copper terminal 8 in the assembling hole 21 of the adapter head 2.

The outer wall of the base 1 and the adapter head 2 are respectively provided with a connector wire fixing part 16 and a plug wire fixing part 26. One end of the connector wire 4 is inserted into the connector wire hole 11 and is electrically connected with the base copper terminal 3, and the other end of the connector wire 4 is outside the base 1 and hung on the connector wire fixing part 16. One end of the plug wire 7 is inserted into the plug wire hole 27 and is electrically connected with the adapter head copper terminal 8, and the other end of the plug wire 7 is outside the adapter head 2 and hung on the plug wire fixing part 26. In this way, it is convenient to fix the wires.

A bulgy rib can be defined at the adapter head 2, and a recess 17 that fits with the bulgy rib can be defined in the base 1. When the adapter head 2 engages with the base 1, the rotation between the adapter head 2 and the base 1 can be prevented by the cooperation of the bulgy rib and the recess 17.

The base 1, the connector plug wires 4, the base copper terminals 3, and the first fixing block 5 constitute the base assembly 100. The adapter head 2, the plug wires 7, the adapter head copper terminals 8, and the second fixing block 6 constitute the adapter head assembly 200.

The working principle of the embodiment is described as follows.

The base 1 can be mounted on the lower section of the tree trunk of the Christmas tree through the assembling section 12, and the adapter head 2 can be inserted into the base 1, and the assembling hole 21 at the upper end of the adapter head 2 is connected with the upper section of the tree trunk of the Christmas tree, so that the adapter can be fixed between two sections of tree trunks. According to the actual situation, multiple adapters can be used to connect with multi-sections of tree trunks. Then during the latter circuit connection period, the corresponding adapter can be found directly on the tree trunk, and the circuit can be connected to light up the lighting on the Christmas tree, by connecting the connector wires and the plug wires with the corresponding components. In detail, the base 1 defines base copper terminals 3, the adapter head 2 defines adapter head copper terminals 8, which are in contact with the base copper terminals 3. After connecting the internal circuit of the adapter, and then the electrical signals are transmitted through the connector wires 4 and the plug wires 7 respectively to achieve the connection between the adapter and the external circuit, thereby connecting the external circuit and the internal circuit of the adapter installed on the tree trunk of the Christmas tree.

The foregoing merely expresses several embodiments of the disclosure, which are described in a relatively specific and detailed manner, but should be understood as a limitation to the scope of the disclosure. It should be pointed out that those ordinary skilled in the art could further make a plurality of transformations and improvements without departing from a concept of the disclosure, which all fall within the protective scope of the disclosure. Therefore, the protective scope of the disclosure should take appended claims as a criterion.

What is claimed is:

1. An adapter, comprising:

a base comprising two base copper terminals mounted thereon and two connector wire holes defined therein, wherein the connector wire hole is configured for inserting a connecting wire to contact with the base copper terminal, wherein an assembling portion protruding out from a bottom end of the base is defined; and an adapter head inserted and fixed on the base, wherein the adapter head comprising two adapter head copper terminals mounted thereon and two plug wire holes defined therein, wherein the two adapter head copper terminals are in contact with the two base copper terminals respectively, wherein the plug wire hole is configured for inserting a plug wire to contact with the base copper terminal, wherein an assembling hole is formed in a top end of the adapter head;

wherein the base defines a first mounting slot extending downwards from the top of the base, a second mounting slot extending upwards from the bottom of the base, and a first hollow out opening extending downwards from the top of the base, the second mounting slot corresponds to the first mounting slot and is located on the outside of the first mounting slot, the first hollow out opening corresponds to and is communicated with the second mounting slot, the first hollow out opening is located on the outside of the second mounting slot, the two base copper terminals are inserted into the first and second mounting slots respectively, a first fixing block mounted on the base is provided at the bottom end of the second mounting slot.

2. The adapter according to claim 1, wherein the assembling hole is a counter bore structure, a third mounting slot is defined extending downwards from the top of the assembling hole, a second hollow out opening is provided beside of the third mounting slot, the base copper terminal of the first mounting slot is exposed in the second hollow out opening, a protrusion is provided at the outer wall of the adapter head and extends downward below the first hollow out opening, a fourth mounting slot is defined in the protrusion extending from the top to the bottom thereof, a second fixing block is defined at the top end of the fourth mounting slot and is mounted on the protrusion, the two adapter head copper terminals are installed in the third mounting slot and the fourth mounting slot, respectively.

3. The adapter according to claim 2, wherein an upper end of the adapter head copper terminal installed in the third mounting slot is bent and snapped onto a step surface of the assembling hole, the plug wire passes through the plug wire hole and is in contact with the bent upper end of the adapter head copper terminal.

4. The adapter according to claim 2, wherein an annular baffle is disposed in the assembling hole and is detachably connected with the adapter head.

5. The adapter according to claim 1, wherein the outer wall of the base defines a connector wire fixing part, and the outer wall of the adapter head defines a plug wire fixing part.

6. The adapter according to claim 1, wherein a bulgy rib is defined at the adapter head, and a recess that exactly engages with the bulgy rib is defined in the base.

7. The adapter according to claim 1, wherein the two base copper terminals are parallel with each other, the two adapter head copper terminals are parallel with each other, the base copper terminals are parallel with the adapter head copper terminals.

8. The adapter according to claim 1, wherein the adapter head defines a third mounting slot and a fourth mounting slot, the two adapter head copper terminals are installed in the third and the fourth mounting slots respectively, the first, the second, the third, and the fourth mounting slots are parallel.

9. The adapter according to claim 1, wherein the adapter head includes a fitting portion at the bottom end thereof, the base defines a fitting hole coaxial with the base, and the fitting portion is exactly engaged in the fitting hole of the base.

10. An adapter, comprising:

a base, comprising:

a fitting hole extending downwards from the top of the base;

a first mounting slot defined adjacent to an inner wall of the base, at least portion of the first mounting slot being exposed in the fitting hole;

a second mounting slot adjacent to an outer wall of the base, at least portion of the second mounting slot being exposed in the exterior;

two base copper terminals installed in the first and second mounting slots, respectively;

two connector wire holes each configured for inserting a connecting wire to contact with the base copper terminal; and an assembling portion positioned at the bottom of the base; and an adapter head, comprising:

a main body;

a fitting portion extending from the bottom of the main body;

a protrusion defined on an outer wall of the main body and comprising a extending portion spaced and opposite to the fitting portion;

a third mounting slot extending from the main body to the fitting portion, at least portion of the third mounting slot being exposed in the exterior;

a fourth mounting slot extending from the protrusion to the extending portion, at least portion of the fourth mounting slot being exposed in the exterior;

two adapter head copper terminals installed in the third and fourth mounting slots, respectively, the two adapter head copper terminals being spaced and opposite to each other;

two plug wire holes each configured for inserting a plug wire to contact with the base copper terminal; and an assembling hole formed in a top end of the main body;

wherein the fitting portion is exactly engaged in the fitting hole of the base, thereby the adapter head copper terminal in the third mounting slot is in contact with the base copper terminal in the first mounting slot, and the adapter head copper terminal in the fourth mounting slot is in contact with the base copper terminal in the second mounting slot.

11. The adapter according to claim 10, wherein an annular baffle is disposed in the assembling hole and is detachably connected with the adapter head.

12. The adapter according to claim 10, wherein the outer wall of the base defines a connector wire fixing part, and the outer wall of the adapter head defines a plug wire fixing part.

13. The adapter according to claim 10, wherein a bulgy rib is defined at the adapter head, and a recess that engages with the bulgy rib is defined in the base.

14. The adapter according to claim 10, wherein the two base copper terminals are parallel with each other, the two adapter head copper terminals are parallel with each other, the base copper terminals are parallel with the adapter head copper terminals.

15. The adapter according to claim 10, wherein the base copper terminals and the adapter head copper terminals each parallel with an axial of the fitting hole.

16. The adapter according to claim 10, wherein the fitting hole is coaxial with the fitting portion.

* * * * *